US005308924A

United States Patent [19]

Lamome

[11] Patent Number: 5,308,924

[45] Date of Patent: May 3, 1994

[54] DEVICE FOR FORMING SOLDER CONNECTIONS

[75] Inventor: Alain Lamome, Pierrelaye, France

[73] Assignee: Raychem SA, France

[21] Appl. No.: 917,035

[22] PCT Filed: Jan. 30, 1991

[86] PCT No.: PCT/GB91/00130

§ 371 Date: Sep. 18, 1992

§ 102(e) Date: Sep. 18, 1992

[87] PCT Pub. No.: WO91/11831

PCT Pub. Date: Aug. 8, 1991

[30] Foreign Application Priority Data

Jan. 30, 1990 [GB] United Kingdom ..... 9002093

[51] Int. Cl.[5] ..... H01R 4/22

[52] U.S. Cl. ..... 174/87; 174/84 R; 174/DIG. 8

[58] Field of Search ..... 174/87, 84 R, DIG. 8

[56] References Cited

U.S. PATENT DOCUMENTS

| | | | |
|---|---|---|---|
| 3,396,460 | 8/1968 | Wetmore | 174/84 R |
| 4,304,959 | 12/1981 | Vidakovits et al. | 174/84 R |
| 4,504,699 | 3/1985 | Dones et al. | 174/84 R |
| 4,654,473 | 3/1987 | Roux et al. | 174/84 R |
| 4,687,280 | 8/1987 | Toy et al. | 174/84 R X |
| 4,722,471 | 2/1988 | Gray et al. | 228/265 |
| 4,806,402 | 2/1989 | Vidakovits | 174/84 R X |

FOREIGN PATENT DOCUMENTS 1062043 3/1967 United Kingdom .

*Primary Examiner*—Morris H. Nimmo

*Attorney, Agent, or Firm*—Herbert G. Burkard; Sheri M. Novack

[57] ABSTRACT

A device for forming a solder connection between a plurality of electrical conductors, comprises a hollow, dimensionally heat-recoverable sleeve 1 formed for example from polyvinylidine fluoride, the sleeve having one end that is open to allow the insertion of the electrical conductors therein, and another end that is closed by a substantially spherical sealing insert.

9 Claims, 1 Drawing Sheet

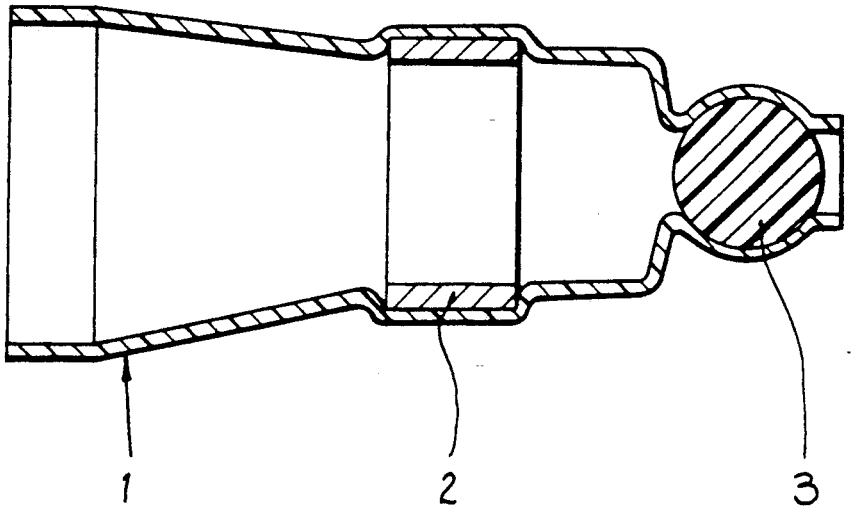
1
2
3

DEVICE FOR FORMING SOLDER CONNECTIONS

This invention relates to devices for forming solder connections between electrical conductors, and, in particular, relates to such devices that are dimen-sionally heat-recoverable.

BACKGROUND OF THE INVENTION

Heat-recoverable articles are articles the dimensional configuration of which may be made substantially to change when subjected to heat treatment.

Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate stage.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Heat-recoverable articles have become widely used for forming solder connections between electrical conductors in view of the ease of forming the connection and the quality of the connection so formed.

For such applications the article, usually in the form of a sleeve, contains a quantity of solder for forming the electrical connection and a pair of fusible inserts for sealing the connection. These articles are described for example in U.S. Pat. Nos. 3,243,211, 4,282,396 and 4,283,596, the disclosures of which are incorporated herein by reference, and are sold by Raychem Corporation, Menlo Park, Calif. under the trade mark "SOLDER SLEEVE".

Such heat-recoverable articles may be used for forming a stub splice, between a pair of wires, in which case both wires are inserted into one end of the sleeve, and the sleeve is then recovered. The devices are usually manufactured with a fusible polymeric sealing ring in the region of each end of the sleeve to provide a seal when the sleeve is recovered about the conductors. Some devices, for example, as described in European Patent Application No. 159,945 are provided with a cylindrical insert in one end of the device which will act as a seal. We have found, however, that the articles employed in the prior art suffer from a number of disadvantages. For example, when the article contains a ring-shaped seal, the seal must be completely melted during recovery of the article so that it will act as a plug. Such a degree of heating is not only time consuming when large quantities of articles are to be installed but also runs risk that the article will be overheated which may cause the article itself or electrical insulation of the conductors to be damaged, or may cause the formation of a poor joint due to migration of the solder. In addition, when the insert is fused it will tend to flow along the sleeve, both towards the centre of the sleeve and out of the end of the sleeve. This fusion of the insert prevents the insert from being used reliably as a stop to limit insertion of the conductors, and also may necessitate lengthening of the sleeve in order to prevent fused sealant flowing out of the end of the sleeve. When a cylindrical insert is employed considerable problems can be experienced during manufacture due to misorientation of the insert within the sleeve which can cause very high rates of scrap during production of the articles. In order to reduce scrap rates it is possible to overheat the article during installation about the wires so that the insert is completely melted and the irregular profile of the sleeve disappears. However, such a solution leads to the same problems of overheating as described above.

SUMMARY OF THE INVENTION

According to the present invention there is provided a device for forming a solder connection between a plurality of electrical conductors, which comprises a hollow, dimensionally heat-recoverable sleeve that contains a quantity of solder, the sleeve having a first end portion that is open to allow insertion of one or more electrical conductors and a second end portion that contains, and is closed by, a substantially spherical sealing insert.

The device according to the present invention has the advantage that the sealing insert cannot be mis-oriented during manufacture of the device and, since it has no passages extending therethrough, need not be melted completely when the device is installed on the electrical conductors. Since the insert can at as a seal without being melted it need not, in the broadest aspect of the invention, be formed from a fusible polymeric material. In general, however, it will be formed from a polymeric material which may be fusible or may be crosslinked to an extent that will prevent the material melting but will not prevent it from becoming soft at the melting point of the polymeric material.

The term "solder" as used herein includes both conventional metallic solder and solder adhesives in which a hot-melt adhesive, e.g. a polyamide hot-melt adhesive, or a thermosetting adhesive such as an epoxy adhesive is filled with metal particles, e.g. with silver flake. In most cases, however, the solder will be a conventional metallic solder, for example a tin/lead or tin/silver eutectic. It is particularly advantageous to employ a solder that is able to provide an indication that the sufficient heat has been applied to the device to form a good solder joint in order to remove or reduce the danger of overheating the device during installation. Thus, for example, the solder may be provided with a thermochromic material as described in European Patent Application No. 76,681. Alternatively the solder insert may be formed from two different solder compositions that melt at different temperatures, melting of the higher melting point solder providing a visual indication that the sufficient heat has been applied to the device to form a good solder joint. Such a device is described in International Patent Application No. PCT/GB88/00335, WO88/09068. The disclosures of these applications are incorporated herein by reference.

In order to form a solder connection, the conductors to be connected are inserted into the device and the device is simply heated for a short length of time in order to recover it about the conductors and to fuse the solder. The device according to the invention may be installed on electrical conductors having low temperature insulation as well as those having high temperature insulation. In view of the fact that it is not necessary to melt the sealing insert completely during installation, it is possible to form a stub splice with a much smaller application of heat than has hitherto been the case.

If the device is intended to be used to form a stub joint between the conductors, so that all the conductors are inserted into the first end portion, the sealing material of the second end portion preferably provides a stop for preventing overinsertion of the conductors.

The material that is used to form the heat-recoverable sleeve will depend among other things on the installation temperature of the device. For example, for very low temperature applications the sleeve may be formed from low, medium or high density polyethylene while for normal applications materials based on polyvinylidine fluoride are preferred. The sealing insert may be formed from any one number of materials. It may be formed from polyvinylidine fluoride as is the sleeve or it may be formed from a material having a lower melting point so that part of the insert softens during installation and thereby improves the ability of the insert to provide a seal. Preferred materials for forming the insert include ethylene homo- or copolymers such as low, medium or high density polyethylene or ethylene/vinyl acetate copolymers.

The device may, if desired, be provided with an additional quantity of sealing material in the region of the first end portion for providing a seal between the sleeve and the inserted conductors. The sealing material may be in the form of an annular insert or as a lining on the heat-recoverable sleeve. Preferably any such material comprises a thermoplastic polymer, for example a polyalkene or a copolymer of an alkene with for example vinyl acetate. The material may be uncrosslinked or it may be lightly cross-linked for example as described in British Patent Specification No. 1,411,943. Alternatively a curable adhesive system may be used to form the sealing material, for example a system as described in European Patent Application No. 84301202.2 in the name of Raychem Limited. The disclosures of these two specifications are incorporated herein by reference.

The device according to the invention may be in the form of a single sleeve as described above, or it may be in the form of a plurality of sleeves that are joined together, each of which contains a quantity of solder and the sealing materials. If it is in the form of a plurality of sleeves for forming multiple connections it may be formed as described in U.K. Patent Specifications Nos. 2,084,505A and 2,082,108A, the disclosures of which are incorporated herein by reference. If desired, the device may be provided with a thermochromic indicator for example as described in U.K. Patent Specification No. 2,109,418A, and/or the sealing material of the second end portion may be arranged to self seal, e.g. as a self-sealing elastomer, as described in U.K. Patent Specification No. 2,116,380A, the disclosures of which are incorporated herein by reference.

BRIEF DESCRIPTION OF THE DRAWING

One form of device in accordance with the invention will now be described by way of example with reference to the accompanying drawing. The FIGURE is a sectional elevation view taken along the axis of the preferred embodiment of the present invention.

DETAILED DESCRIPTION OF THE PREFERRED EMBODIMENT

Referring to the accompanying drawing a device for forming a stub joint between a pair of conductors comprises a heat-shrinkable sleeve 1 formed from polyvinylidine fluoride, an annular solder insert 2 and a spherical sealing insert 3 in the region of one end of the sleeve 1. The device has been formed by extruding a tube of polyvinylidine fluoride, cutting the tube into short lengths, e.g. about 1 to 2 cm in length, and either before or after the tube is cut, radially expanding the tube to about three times its original diameter. The sleeve is then placed on an appropriately shaped mandrel on which the solder insert 2 has been placed, the sealing insert is positioned in the region of the end of the sleeve, and the sleeve is partially recovered about the mandrel, solder insert 2 and sealing insert 3.

In operation, a pair of electrical conductors whose ends have been stripped of insulation are inserted into the open end of the sleeve until their ends abut the sealing insert 3 or that part of the sleeve wall adjacent to the sealing insert. The sleeve is then simply heated by means of a hot-air gun or infrared lamp to cause the sleeve 1 to recover about the conductors and the solder insert 2 to melt and form a solder bond between the conductors. During this operation some melting or softening of the outer surface of the sealing insert 3 may occur.

I claim:

1. A device for forming a solder connection between a plurality of electrical conductors, which comprises a hollow, dimensionally heat-recoverable sleeve that contains a quantity of solder, the sleeve having a first end portion that is open to allow insertion of one or more electrical conductors and a second end portion that contains, and is closed by, a substantially spherical sealing insert.

2. A device as claimed in claim 1, wherein the sealing insert is polymeric.

3. A device as claimed in claim 2, wherein the sealing insert is formed from a crosslinked polymeric material.

4. A device as claimed in claim 2, wherein the sealing insert comprises polyethylene.

5. A device as claimed in claim 1, wherein the second end portion has been partially recovered onto the sealing insert.

6. A device as claimed in claim 3, wherein the sealing insert comprises polyethylene.

7. A device as claimed in claim 2, wherein the second end portion has been partially recovered onto the sealing insert.

8. A device as claimed in claim 3, wherein the second end portion has been partially recovered onto the sealing insert.

9. A device as claimed in claim 4, wherein the second end portion has been partially recovered onto the sealing insert.

* * * * *